US010509357B2

(12) United States Patent
Komatsu et al.

(10) Patent No.: US 10,509,357 B2
(45) Date of Patent: Dec. 17, 2019

(54) IMAGE FORMING APPARATUS

(71) Applicant: CANON KABUSHIKI KAISHA, Tokyo (JP)

(72) Inventors: Isao Komatsu, Kashiwa (JP); Kunihiko Kitayama, Abiko (JP); Genta Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/417,993

(22) Filed: May 21, 2019

(65) Prior Publication Data

US 2019/0271937 A1 Sep. 5, 2019

Related U.S. Application Data

(63) Continuation of application No. PCT/JP2017/042700, filed on Nov. 22, 2017.

(30) Foreign Application Priority Data

Nov. 25, 2016 (JP) ..... 2016-229346

(51) Int. Cl.
*G03G 21/00* (2006.01)
*G03G 15/16* (2006.01)

(52) U.S. Cl.
CPC ..... *G03G 21/0029* (2013.01); *G03G 15/161* (2013.01); *G03G 2221/0005* (2013.01)

(58) Field of Classification Search
CPC ..... G03G 15/161; G03G 21/0029; G03G 21/0088; G03G 2221/0005
See application file for complete search history.

(56) References Cited

U.S. PATENT DOCUMENTS 5,574,538 A * 11/1996 Takahashi ..... B41M 7/0009 347/101
7,174,114 B2 2/2007 Gila et al.
(Continued)

FOREIGN PATENT DOCUMENTS

JP S63-106671 A 5/1988
JP H04-166881 A 6/1992
(Continued)

OTHER PUBLICATIONS

International Search Report dated Feb. 13, 2018, in International Application No. PCT/JP2017/042700.

*Primary Examiner* — Gregory H Curran
(74) *Attorney, Agent, or Firm* — Venable LLP

(57) ABSTRACT

At the time of an end of an image forming job (YES of S1), a controller causes a blade and a developing roller to be separated from a photosensitive drum (S2). At that time, the controller controls separation timing of the belt and the developing roller so that the developing roller is separated from the photosensitive drum before a surface position of the photosensitive drum contacted to the developing roller at a contact position at the time of a start of separation of the blade from the photosensitive drum reaches a developing position with the separation of the blade. According to this, even when a liquid accumulation reaches the developing position depending on the separation of the blade, the developing roller has already been separated from the photosensitive drum before the liquid accumulation reaches the developing position and therefore, the liquid accumulation is not collected by the developing roller. When the liquid accumulation is not collected by the developing roller, color mixture due to the liquid accumulation does not occur.

8 Claims, 6 Drawing Sheets

(56) References Cited

U.S. PATENT DOCUMENTS

| | | | | |
|---|---|---|---|---|
| 2011/0044742 | A1 | 2/2011 | Thayer et al. | |
| 2012/0008974 | A1 | 1/2012 | Kawai et al. | |
| 2012/0201563 | A1* | 8/2012 | Miyazawa ..... | G03G 15/0258 399/92 |
| 2017/0255131 | A1* | 9/2017 | Gan ..... | G03G 15/10 |

FOREIGN PATENT DOCUMENTS

| | | | |
|---|---|---|---|
| JP | 2002-149032 | A | 5/2002 |
| JP | 2008-508562 | A | 3/2008 |
| JP | 2008-165178 | A | 7/2008 |
| JP | 2009-156932 | A | 7/2009 |
| JP | 2009-205095 | A | 9/2009 |
| JP | 2009-229796 | A | 10/2009 |
| JP | 2010-066452 | A | 3/2010 |
| JP | 2011-107471 | A | 6/2011 |
| JP | 2011-154089 | A | 8/2011 |
| JP | 2012-037878 | A | 2/2012 |

* cited by examiner

IMAGE FORMING APPARATUS

TECHNICAL FIELD

The present invention relates to an electrophotographic image forming apparatus for forming an image with a liquid developer.

BACKGROUND ART

Conventionally, the image forming apparatus in which an electrostatic latent image formed on a rotating photosensitive drum is developed into a toner image by using a liquid developer containing a toner and a carrier liquid, and the toner image developed from the electrostatic latent image is primary-transferred onto an intermediary transfer member and further, the toner image transferred on the intermediary transfer member is secondary-transferred onto a recording material has been known. In this apparatus, development of the electrostatic latent image into the toner image has been carried out while the liquid developer accommodated in a developer container is supplied to a drum surface by the developing roller contacted to the drum surface.

Further, in the above-described apparatus, in order to remove the liquid developer containing transfer residual toner remaining on the photosensitive drum after the primary transfer, a cleaning blade (hereinafter simply referred to as a blade) formed in a plate shape with a rubber or the like. However, when this blade is kept in contact with the photosensitive drum on which rotation of this blade is stopped, the blade can adhere to the drum surface with vaporization of the liquid developer remaining on the drum surface or a stripe-shaped deposition matter can be formed at the contact position of the drum surface. In order to avoid this, the blade is provided so as to contactable to and separable from the photosensitive drum and is controlled so as to be separated (spaced) from the drum surface at the time of an end of an image forming job and so as to be contacted to the drum surface at the time of a start of an image forming job. Then, in the case where the blade is separated from the drum surface, a liquid accumulation of the liquid developer formed at the contact position is moved with rotation of the photosensitive drum, and has been collected in the developer container by the developing roller.

Incidentally, in the case of an apparatus capable of forming a color image, a liquid accumulation containing toners of a plurality of colors is formed on the drum surface by the blade in some instances. In such a case, when the liquid accumulation containing the toners of the plurality of colors is collected in the developer container, colors of liquid developers are mixed with each other in the developer container and cause color mixture. When this color mixture of the liquid developers occurs, a color hue to an image changes. Therefore, an apparatus in which a liquid accumulation is removed from a drum surface by supplying a carrier liquid to a blade has been proposed (Tokuhyo 2008-508562).

Further, as an image forming apparatus capable of forming a color image, although an image forming apparatus uses a dry developer, not the liquid developer, an image forming apparatus of a tandem type in which a plurality of photosensitive drums are juxtaposed in a movement direction of an intermediary transfer belt has been conventionally proposed (Japanese Laid-Open Patent Application (JP-A) 2010-66452).

Recently, also in the image forming apparatus using the liquid developer, in order to realize further downsizing, there is a demand for constituting the image forming apparatus of a tandem type as described in JP-A 2010-66452. However, in that case, the color mixture of the liquid developer due to the above-described liquid accumulation is more liable to occur. For example, onto a magenta drum surface provided on a downstream side of an intermediary transfer belt (hereinafter simply referred also to as a belt) with respect to a movement direction of the belt, toner which is a part of a yellow toner image transferred onto the belt on a side upstream of the magenta drum with respect to the movement direction of the belt is moved in some instances (hereinafter, this is referred to as re-transfer, for convenience). Therefore, on the magenta drum surface, a liquid accumulation containing toners of yellow and magenta is capable of being formed.

Further, in order that the liquid accumulation containing the toners of magenta and yellow is not collected in the developer container with separation of the belt, as in the apparatus described in Tokuhyo 2008-508562 described above, it would be considered that the carrier liquid is supplied. However, when a mechanism for supplying the carrier liquid is provided for each of the plurality of photosensitive drums, a structure becomes complicated and a large space for installation is needed, so that it was difficult to employ the mechanism for supplying the carrier liquid. Therefore, an image forming apparatus in which a simple constitution is employed and in which the liquid accumulation formed on the drum surface is not collected by the blade has been conventionally desired, but such an image forming apparatus has not yet been proposed.

Problem to be Solved by the Invention

The present invention has been accomplished in view of the above-described problem and relates to an image forming apparatus of a tandem type using a liquid developer, and an object of the present invention is to provide an image forming apparatus in which color mixture of liquid developers due to a liquid accumulation formed on a drum surface by a blade does not readily occur.

Means for Solving the Problem

An image forming apparatus of the present invention comprises: an image forming portion for forming an image on a recording material; wherein the image forming portion includes, a first image forming portion for forming a toner image; a second image forming portion for forming a toner image different in color from the toner image formed by the first image forming portion; and an intermediary transfer member which is provided rotatably and on which the toner images formed by the first image forming portion and the second image forming portion are transferred, wherein the first image forming portion is provided on a side downstream of the second image forming portion with respect to a rotational direction of the intermediary transfer member and is capable of transferring the toner image onto the intermediary transfer member so as to be superposed on the toner image formed by the second image forming portion, wherein the image forming apparatus further includes, a cleaning member capable of removing the toner images on the intermediary transfer member; and a controller for controlling an operation of the image forming portion, wherein the first image forming portion includes, a first image bearing member; a first developing device, provided so as to be contactable to and separable from the first image bearing member, for developing an electrostatic latent image formed on the first image bearing member by a liquid developer containing first toner at a first developing position opposing the first image bearing member; a first transfer device, to which a first transfer voltage is to be applied, for transferring the toner image formed on the first image bearing member onto the intermediary transfer member at a first transfer position; and a first blade, provided so as to be contactable to and separable from the first image bearing member, for removing the toner image on the first image bearing member, wherein with an end of image formation, the controller causes the first blade to be separated from the first image bearing member during a rotational operation in which the first image bearing member rotates, wherein during the rotational operation, the controller causes the first developing device to be in a separated position where the first developing device is separated from the first image bearing member when a first opposing position of the first image bearing member to the first blade at a time when the first blade is started to be separated from the first image bearing member reaches the first developing position, and wherein during the rotational operation, the controller causes the first image bearing member to rotate so that the first opposing position passes through the first transfer position after the first blade is separated, and causes the liquid developer remaining on the first image bearing member at the first opposing position to be transferred onto the intermediary transfer member and causes the cleaning device to collect the transferred liquid developer.

Effect of the Invention

According to the present invention, by controlling separation timing of each of the first blade and the first developing means, a liquid accumulation formed on a surface of the first image bearing member is prevented from being collected by the first developing device, and therefore, color mixture of the liquid developers due to the liquid accumulation does not readily occur.

EMBODIMENTS FOR CARRYING OUT THE INVENTION

First Embodiment

First embodiment will be described. First, a general structure of an image forming apparatus in this embodiment will be described using FIG. 1.

(Image Forming Apparatus)

An image forming apparatus 100 in this embodiment is a full-color printer of a tandem type and an intermediary transfer type in which a plurality of image forming portions PY, PM, PC and PBk are arranged. In this embodiment, four image forming portions PY and PBk are disposed equidistantly in series in a movement direction of an intermediary transfer belt 91 in an order of yellow, magenta, cyan and black from an upstream side with respect to the movement direction.

The image forming apparatus 100 is capable of outputting, to a recording material S, a color image formed depending on image information from an unshown external host device, such as a personal computer or an image reading device, communicatable with an apparatus main assemble. As the recording material S, it is possible to cite, for example, a cut sheet (paper) of 60-350 g/m$^2$ in average basis weight, an OHP (over head transparency) sheet, and the like. In the case where the color image is outputted, the image forming apparatus 100 generates an image signal color-separated in accordance with a print signal sent from the external host device and forms toner images of the respective colors by the respective image forming portions PY to PBk depending on this image signal. Then, the image forming apparatus 100 subjects the respective color toner images formed by the image forming portions PY to PBk to continuous multiple-transfer onto the belt 91 moving in a predetermined direction, and thereafter subjects the multiple-transferred toner images to collective transfer from the belt 91 onto the recording material S. The recording material S on which the toner images are collectively transferred is fed to a fixing device 13. The recording material P is fed to the fixing device 13 and is subjected to heating and pressing or to ultraviolet irradiation, whereby the toner images are fixed on the recording material S. The recording material S on which the toner images are fixed by the fixing device 13 is discharged to an outside the image forming apparatus. Thus, a color image is outputted onto the recording material S.

[Image Forming Portion]

The image forming portions PY to PBk for forming the images of the respective colors of yellow (Y), magenta (M), cyan (C) and black (Bk) will be described using FIG. 2. However, the image forming portions PY to PBk are constituted so as to be the same except that colors of toners used in developing devices 4Y to 4Bk are different from each other, and therefore in the case where there is no need to particularly differentiate the image forming portions, description will be made by emitting suffixes Y, M, C and Bk of symbols added for differentiating the image forming portions PY to PBk.

Figure 2:
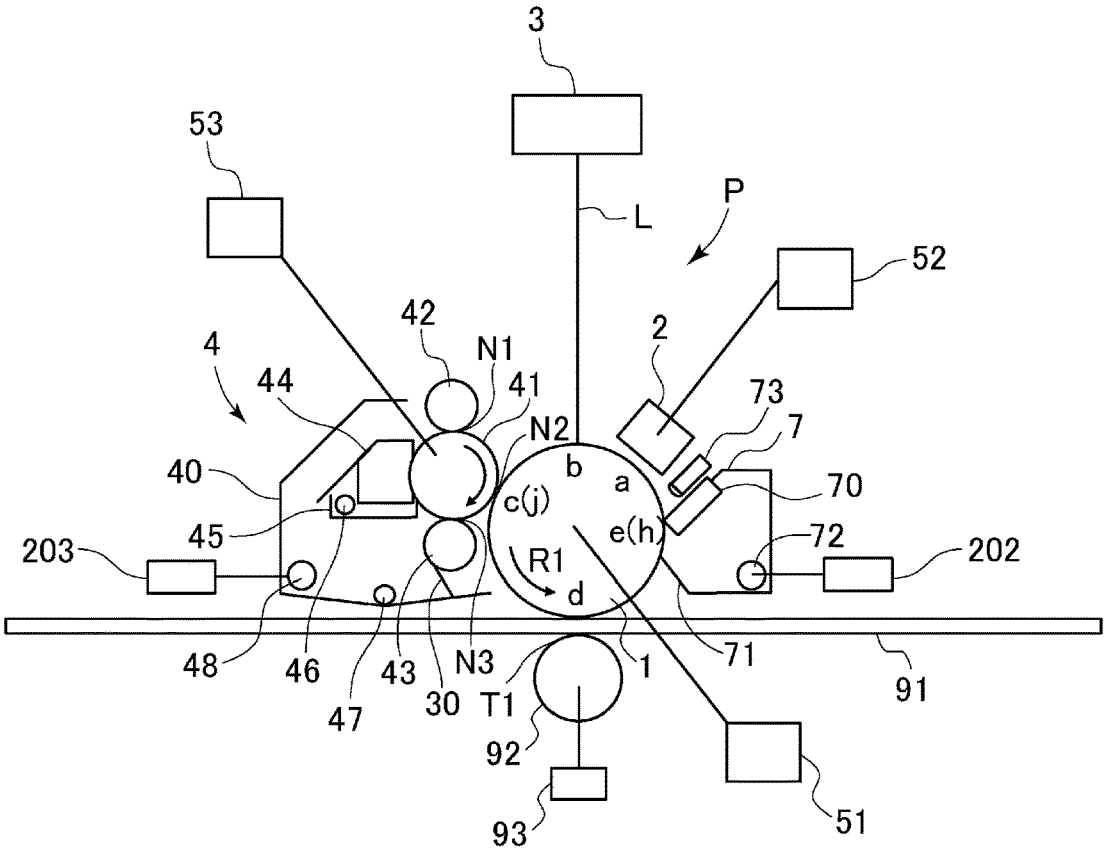
FIG. 2 is a sectional view showing a structure of an image forming portion.

As shown in FIG. 2, at the image forming portion P, a charging device 2, an exposure device 3, the developing device 4 and a drum cleaning device 7 are provided so as to encircle a photosensitive drum 1. The photosensitive drum 1 as a first image bearing member or a second image bearing member is an organic photoconductor (OPC) drum in which an amorphous silicon photosensitive layer is formed on an outer peripheral surface of an electroconductive cylinder made of aluminum. In this embodiment, the photosensitive drum 1 of 84 mm in outer diameter and 380 mm in longitudinal width (length with respect to a rotational axis direction) was used. The photosensitive drum 1 is rotated in an arrow R1 direction in the figure at a process speed of, for example, 500 mm/sec by a driving motor 51. Incidentally, in general, the photosensitive drum 1, a developing roller 41 and the belt 91 are driven at the same process speed.

The charging device 2 is, for example, a corona charger of scorotron type and electrically charges the surface of the photosensitive drum 1 to a uniform negative (−polarity) dark portion potential (for example, −500 V). The corona charger charges the surface of the photosensitive drum 1 by application of a DC voltage by a charging voltage source 52 to a discharge wire which is shielded by metal such as aluminum and which is made of tungsten or stainless steel in a diameter of about 50-100 μm.

The photosensitive drum 1 is subjected to image exposure (laser light L) by the exposure device 3 after being charged by the charging device 2. The exposure device 3 generates a laser beam, from a laser light emitting element, obtained by subjecting scanning line image data developed from separated color image of each of the colors to ON-OFF modulation and writes an electrostatic latent image for an image on the surface of the charged photosensitive drum 1 by scanning with a rotating mirror. By such laser scanning exposure, of the drum surface, a portion irradiated with the laser light L lowers in potential compared with another portion, so that the electrostatic latent image corresponding to the image information is formed. In this embodiment, an exposure portion potential was −100 V.

[Liquid Developer]

Then, the electrostatic latent image formed on the photosensitive drum 1 is developed by a liquid developer with the developing device 4. In the developing device 4 as a first developing means or a second developing means, the liquid developer in which particulate toner which is a dispersoid is dispersed in a carrier liquid which is a dispersion medium is accommodated, and the developing device 4 develops the electrostatic latent image with the liquid developer. In this embodiment, a liquid developer in which resin toner which contains a pigment of each of yellow, magenta, cyan and black and which has a center particle size (diameter) of 1 μm was dispersed in a carrier liquid which is a silicone solvent, hydrocarbon, ethers or the like and which has volume resistivity of $1\times10^{10}$ ohm cm was used. As a matter of course, the liquid developer is not limited to this, but for example, a liquid developer of an ultraviolet radiation curable type may also be used.

[Developing Device]

A constitution and a developing operation will be described. As shown in FIG. 2, the developing device 4 includes a developer container 40 forming a casing, a developing roller 41, a squeeze roller 42, a cleaning roller 43, an electrode segment 44, a supplying tray 45, a removing member 30 and the like.

In the developer container 40, a liquid developer containing single color toner and a carrier liquid is accommodated. The developing container 40 opens at a part thereof opposing the photosensitive drum 1 as shown in FIG. 2, so that at this opening, the developing roller 41 is rotatably provided so as to expose at a part thereof. The developing roller 41 is formed in a cylindrical shape and is rotated in the same direction as the photosensitive drum 1 at an opposing surface to the photosensitive drum 1. On a side opposite from the opposing surface of the developing roller 41 to the photosensitive drum 1, the electrode segment 44 is disposed opposed to the developing roller 41 with a gap which is a predetermined interval (for example, 0.5 mm) between the electrode segment 44 and the photosensitive drum 1. Below the electrode segment 44, the supplying tray 45 is disposed, and the liquid developer is drawn up into the above-described gap from the supplying tray 45 by a rotating force of the developing roller 41. The supplying tray 45 temporarily stores the liquid developer supplied from an unshown mixer so that the developing roller 41 can draw up the liquid developer by rotation thereof.

The electrode segment 44 forms an electric field between itself and the developing roller 41 under application of a voltage of, for example, −500 V by an unshown voltage source. In accordance with this electric field, the toner contained in the liquid developer drawn up into the above-described gap shifts toward a surface side of the developing roller 41. On a side downstream of the electrode segment 44 with respect to a rotational direction of the developing roller 41, the squeeze roller 42 is disposed. The squeeze roller 42 forms a nip (portion) N1 in contact with the developing roller 41. Of the liquid developer on the developing roller 41 passed through an opposing region to the electrode segment 44, the toner shifted toward the surface side of the developing roller 41 and a part of the carrier liquid pass through the nip N1 of the squeeze roller 42. The liquid developer which does not pass through the nip N1 of the squeeze roller 42 flows along an upper surface of the electrode segment 44 and drops on a bottom side of the developer container 40. Incidentally, to the squeeze roller 42, a voltage of, for example, −350 V is applied by an unshown voltage source.

In the case of this embodiment, the developing device 4 is provided rotatably about a rotation shaft 48. By rotation of the developing device 4, the developing roller 41 is movable between a position where the developing roller 41 is capable of supplying the liquid developer to the photosensitive drum 1 in contact with the photosensitive drum 1 at a predetermined pressure (for example, 30N) and a position remoter from the photosensitive drum 1 than this suppliable position is. Further, to the developing roller 41, a developing voltage of, for example, −300 V is applied by a developing voltage source 53 in a state in which the developing roller 41 contacts the photosensitive drum 1. In that case, the liquid developer passed through the nip N1 of the squeeze roller 42 is fed to a developing position c, whereby the electrostatic latent image on the photosensitive drum 1 is developed into a toner image. That is, the toner in the liquid developer fed to the developing position c is selectively deposited correspondingly to the electrostatic latent image formed on the photosensitive drum 1, by an electric field by the developing voltage. Thus, the electrostatic latent image on the photosensitive drum 1 is developed into the toner image. The developing position c is a developing nip (portion) N2, formed by the developing roller 41 and the photosensitive drum 1, as a predetermined position with respect to the rotational direction of the photosensitive drum 1 where the electrostatic latent image formed on the photosensitive drum 1 is capable of being developed into the toner image by the liquid developer.

On a side downstream of the developing nip N2 with respect to the rotational direction of the developing roller 41, the cleaning roller 43 is disposed. The cleaning roller 43 collects the toner contained in the liquid developer remaining on the developing roller 41 after passing through the developing nip N2 by using an electrostatic force, and in addition, removes the carrier liquid after the toner collection under application of pressure at a collecting nip (portion) N3. Further, on a side downstream of the collecting nip N3 with respect to the rotational direction of the cleaning roller 43, the removing member 30 is disposed. The removing member 30 is a plate-like elastic member extended in a longitudinal direction of the cleaning roller 43, and scrapes and drops the toner and the carrier liquid on the cleaning roller 43 in contact with the cleaning roller 43. The carrier liquid removed by the cleaning roller 43, and the toner and the carrier liquid which are scraped and dropped by the removing member 30 fall on the bottom side of the developer container 40. Incidentally, to the cleaning roller 43, a voltage of, for example, −150 V is applied by an unshown voltage source.

The liquid developer fallen on the bottom side of the developer container 40 is returned to the unshown mixer and is re-utilized. For that purpose, on the bottom side of the developer container 40, a discharge opening (port) 47 communicating with the mixer is provided, and the discharge opening 47 is configured to permit discharge of the developer therefrom.

Returning to description of the image forming portion, the respective color toner images formed on the photosensitive drum 1 are successively primary-transferred superposedly onto the belt at a primary transfer position d. On an inner peripheral surface side of the belt 91, a primary transfer roller 92 is provided opposed to the photosensitive drum 1 while sandwiching the belt 91 between itself and the photosensitive drum 1. The primary transfer roller 92 is formed of, for example, an electroconductive sponge, and forms a primary transfer nip (portion) T1 between the photosensitive drum 1 and the belt 91 by pressing the belt 91 against the photosensitive drum 1. The primary transfer position d as a first primary transfer position or a second primary transfer position is the primary transfer nip T1. The primary transfer roller 92 is maintained in a state, in which the belt 91 is pressed by the primary transfer roller 92, until the photosensitive drum 1 and the belt 91 are stopped. To the primary transfer roller 92, a primary transfer voltage source 93 for applying a primary transfer voltage as a first primary transfer voltage or a second primary transfer voltage is connected. By applying the primary transfer voltage (for example, +200 V) to the primary transfer roller 92, the primary transfer of the toner image from the photosensitive drum 1 onto the belt 91 is carried out at the primary transfer position d. In the case of this embodiment, the primary transfer roller 92 and the primary transfer voltage source 93 are combined with each other and function as a first primary transfer means or a second primary transfer means. Primary transfer residual toner remaining on the photosensitive drum 1 (on the first image bearing member or on the second image bearing member) without being transferred onto the belt 91 at the primary transfer position d is removed from the photosensitive drum 1 by the drum cleaning device 7.

[Drum Cleaning Device]

The drum cleaning device 7 includes a blade 70 and a receptor sheet 71. The blade 70 as a first blade or a second blade is disposed on a side upstream of the above-described developing position c with respect to the rotational direction of the photosensitive drum 1 and on a side downstream of the above-described primary transfer position d with respect to the rotational direction of the photosensitive drum 1. The blade 70 contacts the photosensitive drum 1 at a contact position e and cleans the photosensitive drum 1 so as to mechanically scrape off the primary transfer residual toner. The blade 70 is formed in a plate shape of 3 mm in thickness and 370 mm in longitudinal width by an urethane-based material of, for example, JIS-A rubber hardness of 80°. Further, the blade 70 is contacted to the photosensitive drum 1 counterdirectionally with an angle of about 25 degrees relative to the photosensitive drum 1 so that an entering amount thereof into the drum surface with a free length of, for example, 10 mm is about 0.5 mm. In the case of this embodiment, the drum cleaning device 7 is provided rotatably about a unit rotation shaft 72. By rotation of the drum cleaning device 7, the blade 70 is movable between a position where the drum cleaning device 7 is capable of removing the toner in contact with the photosensitive drum 1 and a position remoter from the photosensitive drum 1 than this removable position is.

The receptor sheet 71 is capable of accumulating the liquid developer in a predetermined amount (for example, about 10 mm) between the drum surface of the rotating photosensitive drum 1 and the blade 70 in contact with the photosensitive drum 1 on a side upstream of the blade 70 with respect to the rotational direction of the photosensitive drum 1. The receptor sheet 71 is formed in a plate shape of 0.05 mm in thickness and 370 mm in longitudinal width by using, for example, polyethylene terephthalate (PET). Further, the receptor sheet 71 is contacted to the photosensitive drum 1 with an angle of about 30 degrees with respect to the photosensitive drum 1 so that an entering amount thereof into the drum surface with a free length of, for example, 10 mm is 1.0 mm.

On a side downstream of the drum cleaning device 7 with respect to the rotational direction of the photosensitive drum 1, a discharging device 73 consisting of an LED array with a center wavelength of, for example, 680 mm is provided. The discharging device 73 is adjusted so that an exposure amount thereof is, for example, about 3 $\mu J/cm^2$ in order to lower a surface potential of the photosensitive drum 1 to a predetermined potential (for example, 0 V).

Returning to FIG. 1, the belt 91 is extended around and stretched by a tension roller 94, a driving roller 95 and a secondary transfer inner roller 96, and is rotated in an arrow R2 direction in the figure by being rotated by the driving roller 95. As described above, the toner images successively primary-transferred superposedly on the belt are secondary-transferred collectively onto the recording material S which has been conveyed to a secondary transfer portion T2. The secondary transfer portion T2 is a toner image transfer nip onto the recording material S, formed by contact of a secondary transfer outer roller 10 with the belt 91 stretched by the secondary transfer inner roller 96. At the secondary transfer portion T2, the toner images are secondary-transferred from the belt 91 onto the recording material S by applying a secondary transfer voltage to the secondary transfer outer roller 10 by an unshown voltage source.

Secondary transfer residual toner remaining on the belt 91 (on the intermediary transfer member) after the secondary transfer while being deposited on the belt 91 is collected by a belt cleaning device 11. The belt cleaning device 11 includes two metal rollers 11*a*, and these metal rollers 11*a* rubs the belt 91 and removes the secondary transfer residual toner from the belt 91. At this time, to the metal rollers 11*a*, a voltage of, for example, +100 V is applied by an unshown voltage source.

Incidentally, as the belt 91, a rubber belt which is a resin type or which contains a metal core, or a belt comprising a resin (material) and a rubber, or the like can be suitably used. In this embodiment, for example, a two-layer structure resin belt in which a 200 μm-thick NBR (nitrile-butadiene rubber) is used as a surface layer and a 50 μm-thick PI (polyimide) is used as a base layer and in which an electric resistance of entirety of the belt by dispersing carbon black in the base layer was used. Further, the belt 91 of 360 mm in longitudinal width and 3500 mm in full circumference was used.

[Controller]

The image forming apparatus 100 of this embodiment includes a controller 200. The controller 200 will be described using FIG. 3 while making reference to FIG. 2. Incidentally, with the controller 200, in addition to the illustrated members, various devices such as motors and voltage sources and the like for operating the image forming apparatus 100 are connected. However, here these members are not the main object of the present invention and therefore are omitted from illustration and description.

The controller 200 as a control means carries out various pieces of control of the image forming apparatus 100, such as an image forming operation, and includes an unshown CPU (Central Processing Unit). To the controller 200, a memory 201 as a storing means, such as an ROM, an RAM or a hard disk device is connected. In the memory 201, various programs, data and the like for controlling the image forming apparatus 100 are stored. The controller 200 executes an image forming job stored in the memory 201 and is capable of causing the image forming apparatus 100 to carry out image formation. In the case of this embodiment, the controller 200 is capable of executing a separation (spacing) control for separating (spacing) the blade 70 and the developing roller 41 from the photosensitive drum 1 at the time of an end of the image forming job (i.e., during post-rotation). The separation control will be described later (see FIG. 4). Incidentally, in the memory 201, calculation process results with execution of various control programs, and the like are also temporarily stored.

The image forming job is a series of operations from a start of the image formation until the image forming operation is completed, on the basis of a print signal for forming the image on the recording material S. That is, the image forming job is a series of operations from a start of a preparatory operation (so-called a pre-rotation operation) required for carrying out the image formation until a preparatory operation (so-called a post-rotation) required for ending the image formation toner the image forming step. Specifically, the image forming job refers to the operations from the time of the pre-rotation (preparatory operation before the image formation) after receiving the print signal (reception of the image forming job) to the post-rotation (operation after the image formation), and includes an image forming period and a sheet interval. Herein, during post-rotation is a period from an end of final image formation of the image forming job until rotations of the photosensitive drums 1Y to 1Bk and the belt 91 and the like which are continuously rotated without forming the toner images are stopped.

To the controller 200, in addition to the memory 201, the charging voltage source 52, the developing voltage source 53, the primary transfer voltage source 93, a blade contact and separation means 202, a developing roller contact and separation means 203 and a display portion 204 are connected via unshown interfaces. As described above, the charging voltage source 52 applies the DC voltage to the charging device 2 and causes the charging device 2 to electrically charge the surface of the photosensitive drum 1. The developing voltage source 53 applies the developing voltage to the developing roller 41 and causes the developing roller 41 to develop the electrostatic latent image into the toner image by the liquid developer. The primary transfer voltage source 93 applies the primary transfer voltage to the primary transfer roller 92, so that the toner image formed on the photosensitive drum 1 is primary-transferred onto the belt 91. Further, during execution of the separation control (see FIG. 4) described later, the primary transfer voltage source 93 causes the toner contained in a liquid accumulation to be transferred from the photosensitive drum 1 onto the belt 91.

The blade contact and separation means 202 is a motor, an operation mechanism and the like for rotating the drum cleaning device 7 about the unit rotation shaft 72. The developing roller contact and separation means 203 is a motor, an operation mechanism and the like for rotating the developing device 4 about the rotation shaft 48. The display portion 204 is, for example, a liquid crystal display on which an operation state of the apparatus main assembly and a menu presenting the various control programs, such as an executable image forming job, to a user is displayed. Incidentally, the controller 200 causes the display portion 204 to display a vertical operation element, and by using this vertical operation element, an execution start operation and a data input operation and the like of the image forming job by the user may also be made receivable.

Incidentally, in the case where the photosensitive drum 1 is stopped, when the blade 70 is kept in contact with the photosensitive drum 1, as has already been described, the blade 70 can adhere to the drum surface or the stripe-shaped deposition matter is capable of being formed in the neighborhood of the contact position e. In order to avoid this, the blade 70 is separated from the drum surface at the time of an end of the image forming job. However, in the case of the image forming apparatus of the tandem type and the intermediary transfer type, the color mixture of the liquid developers due to the liquid accumulation can occur in other image forming portions PM to PBk (specifically the developing devices 4M to 4Bk) except for the yellow image forming portion PY disposed on a most upstream side with respect to the movement direction of the belt 91. For example, in the case of the magenta image forming portion PM, when a yellow toner image primary-transferred on the belt 91 at the image forming portion PY passes through the primary transfer position d, a part of the yellow toner image is capable of being re-transferred from the belt 91 onto the photosensitive drum 1M although an amount of the yellow toner image is 10% or less. Particularly, such re-transfer of the toner is liable to occur in the case of a solid image having an image ratio closer to 100%. The re-transfer of the toner occurs at the primary transfer position d, and therefore, on the surface of the magenta photosensitive drum 1M, a liquid accumulation containing yellow toner in addition to magenta toner is capable of being formed. Similarly, on the surface of the cyan photosensitive drum 1C, a liquid accumulation containing the yellow and magenta toners in addition to cyan toner is capable of being formed, and on the surface of the black photosensitive drum 1Bk, a liquid accumulation containing the yellow, magenta and cyan toners in addition to the black toner is capable of being formed.

Further, with separation of the blade 70, when the liquid accumulation containing another color toner (other color toners) is collected in the developing device 4 via the developing roller 41 contacting the drum surface on a side downstream of the blade 70 with respect to the rotational direction of the photosensitive drum 1, color mixture of the liquid developers occurs. Therefore, in this embodiment, in order that the liquid accumulation formed by the blade 70 is not collected in the developing device 4, the blade 70 and the developing roller 41 were separated from the photosensitive drum 1 by adjusting separation timing. In the following, description will be made.

Figure 1:
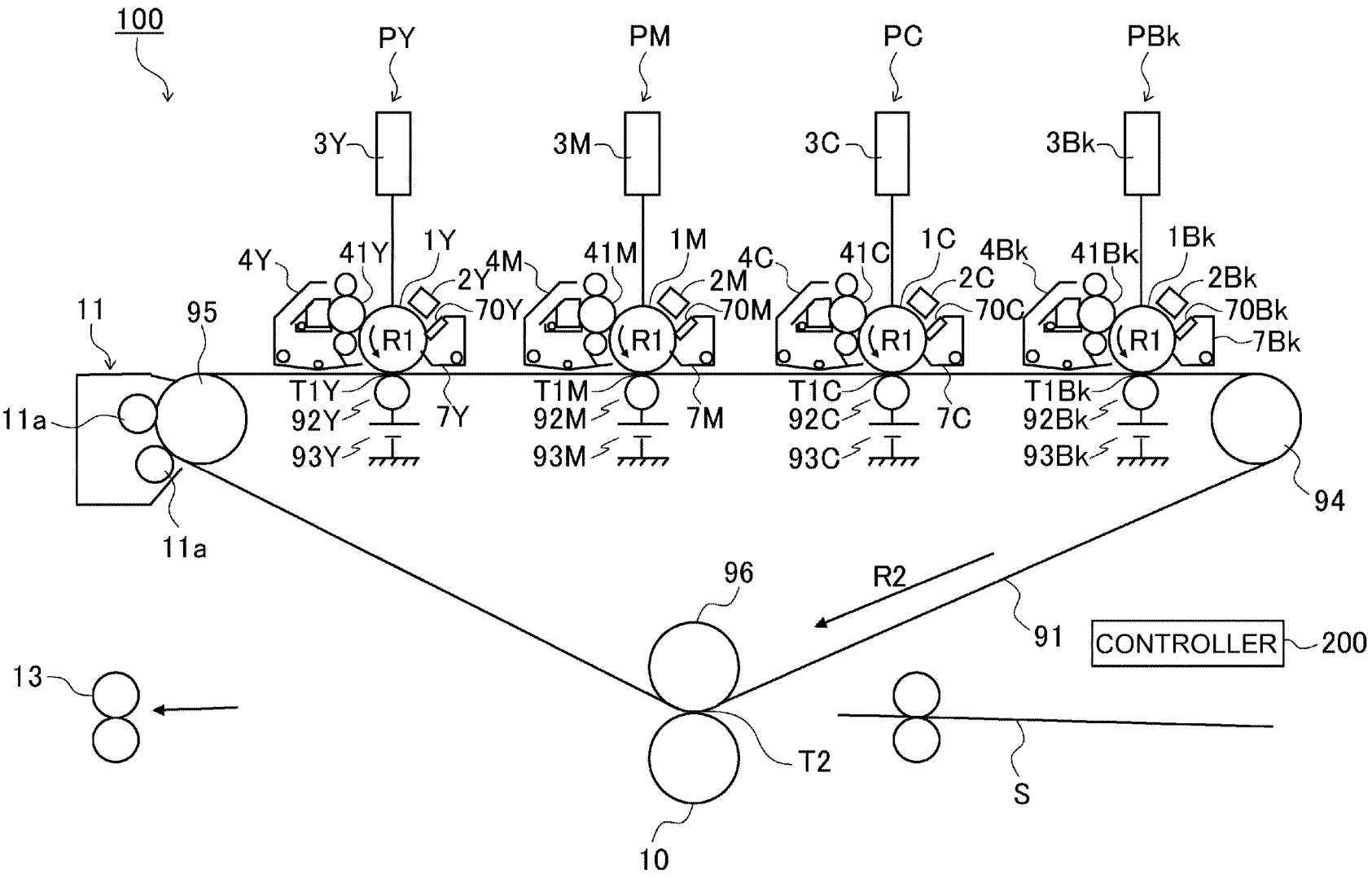
FIG. 1 is a schematic view showing a structure of an image forming apparatus of this embodiment.
Figure 3:
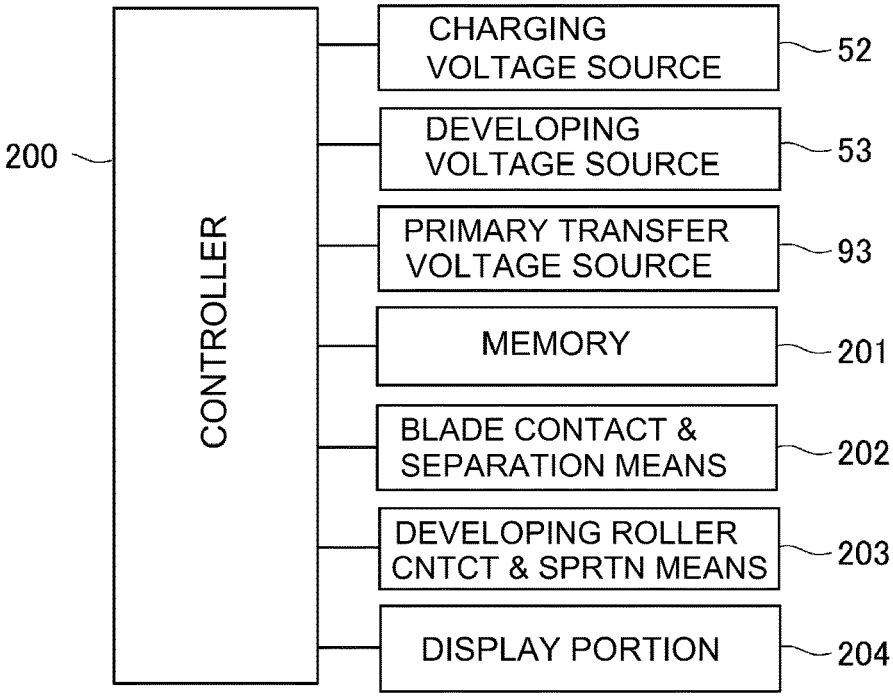
FIG. 3 is a control block diagram showing a separation control system of a blade and a developing roller.
Figure 4:
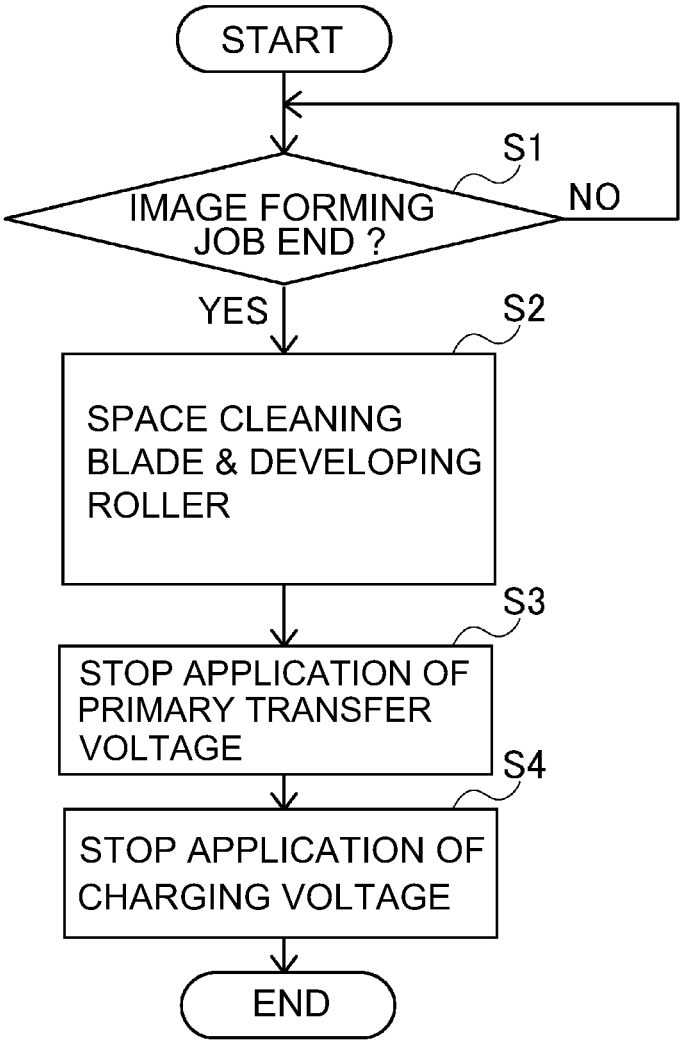
FIG. 4 is a flowchart showing separation control in First Embodiment.

Separation control in First Embodiment will be described using FIG. 4 to part (b) of FIG. 5 while making reference to FIGS. 1 to 3. The separation control in First Embodiment is shown in FIG. 4. The controller 200 starts the separation control shown in FIG. 4 with execution of the image forming job. Incidentally, the controller 200 carries out the separation control shown in FIG. 4 for each of the image forming portions PY to PBk, but separation timing of the blade 70 and separation timing of the developing roller 41 are almost the same time at all the image forming portions PY to PBk.

The controller 200 discriminates whether or not the image forming job should be ended (S1). The controller 200 is on standby without proceeding with a process until the controller discriminates that the image forming job should be ended (NO of S1), and when the controller 200 discriminates that the image forming job should be ended (YES of S1), processes of 2 and later are carried out. At the time of an end of the image forming job, i.e., during post-rotation, the controller 200 separates (spaces) the blade 70 and the developing roller 41 from the photosensitive drum 1 (S2). The controller 200 separates the blade 70 from the photosensitive drum 1 by causing the blade contact and separation means 202 to rotate the drum cleaning device 7 and separates the developing roller 41 from the photosensitive drum 1 by causing the developing roller contact and separation means 203 to rotate the developing device 4. At that time, the controller 200 controls respective separation timings so that the developing roller 41 is separated before a surface position of the photosensitive drum 1 to which the blade 70 had been contacted at the contact position e at the time of a start of separation of the blade 70 reaches the developing position d with the separation of the blade 70. In the case of this embodiment, as specifically described later (see part (a) of FIG. 5 and part (b) of FIG. 5), the case where the blade 70 is separated earlier than the developing roller 41 and the case where the developing roller 41 is separated earlier than the blade 70 exist.

After the blade 70 and the developing roller 41 are separated, the controller 200 causes the primary transfer voltage source 93 to stop application of the primary transfer voltage to the primary transfer roller 92 (S3). After the stop of the application of the primary transfer voltage, the controller 200 causes the charging voltage source 52 to stop application of the charging voltage to the photosensitive drum 1 (S4).

Figure 5:
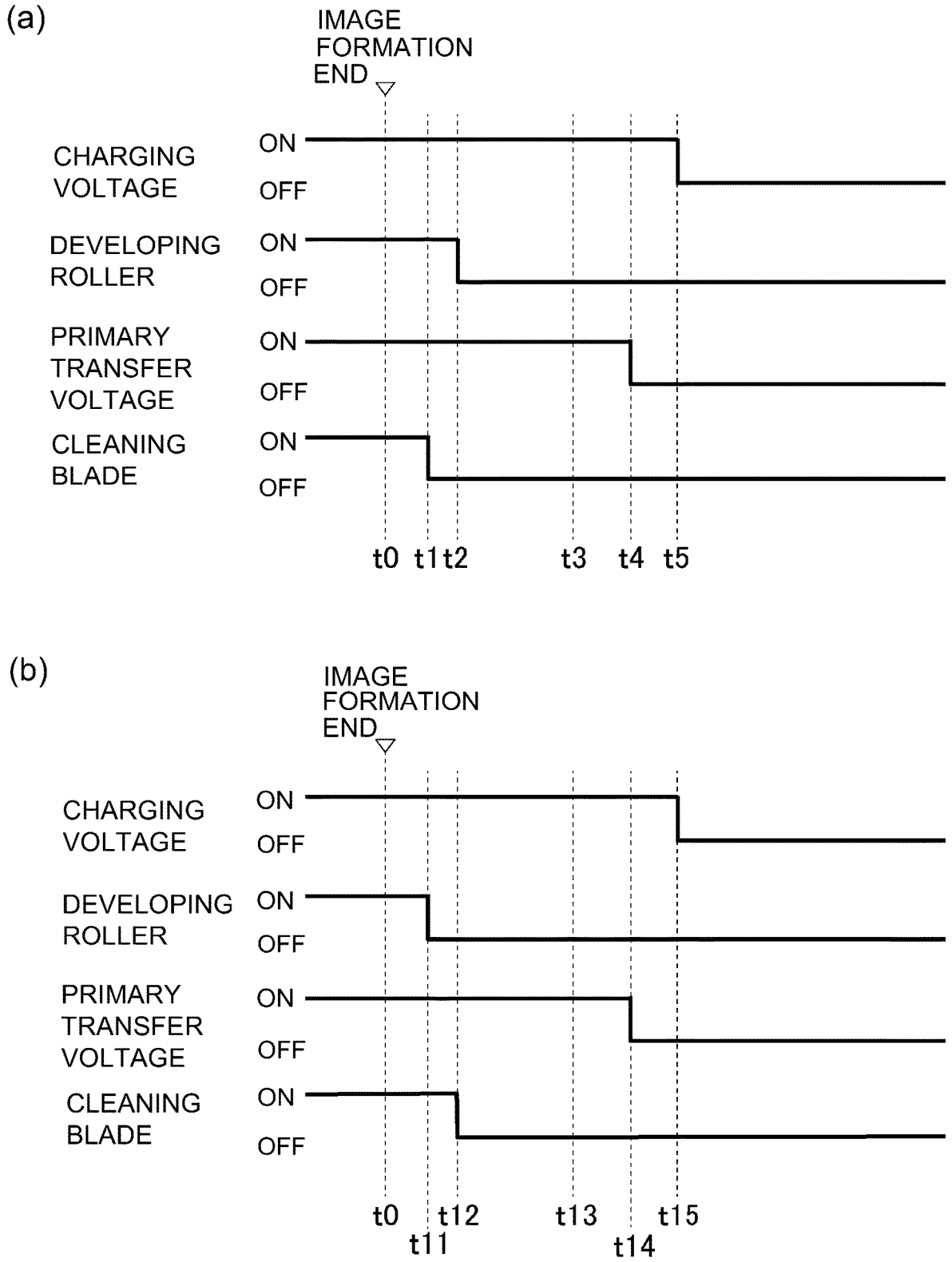
FIG. 5 includes timing charts for illustrating the separation control in First Embodiment, in which part (a) of FIG. 5 shows the case where the blade is separated earlier, and part (b) of FIG. 5 shows the case where the developing roller is separated earlier.

In part (a) of FIG. 5 and part (b) of FIG. 5, timing charts of the separation control shown in FIG. 4 in First Embodiment are shown. Part (a) of FIG. 5 shows the case where the blade 70 is separated earlier than the developing roller 41, and part (b) of FIG. 5 shows the case where the developing roller 41 is separated earlier than the blade 70. Incidentally, in this embodiment, a time required for one rotation (turn) of the photosensitive drum 1 was 528 ms. Further, a time required for rotation of the photosensitive drum 1 from the contact position e to the developing position c was 220 ms, a time required for rotation of the photosensitive drum 1 from the developing position c to the primary transfer position d was 176 ms, and a time required for rotation of the photosensitive drum 1 from the primary transfer position d to the contact position e was 132 ms. Further, a time required for movement of the belt 91 between the primary transfer positions d of adjacent image forming portions was 499 ms.

First, the case where the blade 70 is separated earlier than the developing roller 41 will be described. As shown in part (a) of FIG. 5, in the case where the image formation is ended (t0), the blade 70 is started to be separated from the photosensitive drum 1 (t1, OFF). Here, the case where the image formation is ended is the case where a trailing end of a final toner image which is an image formation object on a downstream side with respect to the rotational direction of the photosensitive drum 1 passed through the contact position e. That is, the blade 70 is not separated until removal of transfer residual toner of the final toner image which is the image formation object is ended. After separation of the blade 70 (t1 and later), the developing roller 41 is started to be separated from the photosensitive drum 1 (t2, OFF). However, separation timing of the developing roller 41 falls within the time (220 ms) required for rotation of the photosensitive drum 1 from the contact position e to the developing position c. That is, the developing roller 41 is separated before the surface position (referred to as a drum position h) of the photosensitive drum 1 to which the blade 70 is contacted at the contact position e at the time of the start of separation of the blade 70 reaches the developing position c. The drum position h is a leading end position, of the liquid accumulation formed by the blade 70, on a downstream side with respect to the rotational direction of the photosensitive drum 1. Incidentally, in the case of this embodiment, the blade 70 and the developing roller 41 are separated substantially at the same timing.

After the separation of the developing roller 41 (t2 and later), the drum position h passes through the primary transfer position d and thereafter (t3 and later), application of the primary transfer voltage is stopped (t4). In the case of this example, a time required for arrival of the drum position h at the primary transfer position d is 396 ms (220+176), and thereafter the application of the primary transfer voltage is stopped. Thus, the primary transfer voltage is applied until the liquid accumulation passes through the primary transfer position d, so that the toner contained in the liquid accumulation is transferred onto the belt 91. The toner transferred on the belt 91 is collected by the belt cleaning device 11. That is, the controller 200 causes the belt 91 to rotate after the liquid accumulation is transferred on the belt 91 and until the liquid accumulation transferred on the belt reaches the belt developing device 11. Then, after the liquid accumulation transferred on the belt 91 passes through the belt cleaning device 11, a bias applied to the belt cleaning device 11 is turned off After application of the primary transfer voltage (t4 and later), application of the charging voltage is stopped (t5). The stop of the application of the charging voltage may preferably be carried out after a lapse of a time (for example, 100 ms) required that a voltage value of the primary transfer voltage source 93, i.e., the primary transfer voltage becomes almost 0. Incidentally, the stop of the application of the developing voltage to the developing roller 41 may be any time after the separation of the developing roller 41 although illustration in the figure is omitted. Further, in a period from after the separation of the developing roller 41 to the stop of the application of the primary transfer voltage (t4), the toner contained in the liquid accumulation may also be transferred on the belt 91 with reliability by causing the drum position h to pass through the primary transfer position d plural times.

Next, the case where the developing roller 41 is separated earlier than the blade 70 will be described. As shown in part (b) of FIG. 5, in the case where the image formation is ended (t0), the developing roller 41 is started to be separated from the photosensitive drum 1 (t11). After separation of the blade 70 (t11 and later), the blade 70 is separated from the photosensitive drum 1 (t12). The separation timing of the blade 70 falls within the time (308 ms) required for rotation of the photosensitive drum 1 from the developing position c to the contact position e (t13). That is, the blade 70 is separated before an opposing position of the photosensitive drum 1 opposing the developing position c at the time of the start of separation of the developing roller 41 reaches the contact position e. In this case, the liquid developer is not supplied to the photosensitive drum 1 by the separation of the developing roller 41. For that reason, in the case where the blade 70 is left in the contact state, on and after the opposing position j where there is substantially no liquid developer reaches the contact position e, the blade 70 can be turned up or the drum surface can be damaged. In order to avoid this, the blade 70 is separated during contact thereof with the drum surface in a state in which the liquid developer exists.

After the separation of the blade 70 (t12 and later), the drum position h passes through the primary transfer position d and thereafter (t13 and later), application of the primary transfer voltage is stopped (t14). After application of the primary transfer voltage (t14 and later), application of the charging voltage is stopped (t15). These may only be required to be controlled similarly as the above-described case where the blade 70 is separated earlier than the developing roller 41.

The present inventors conducted an experiment of checking an amount of the yellow toner included in the magenta liquid developer after images are formed on recording materials of 100 sheets×1000 sets by using the above-described image forming apparatus 100. As regards the toner images subjected to the image formation, the yellow toner image is a whole surface solid image and the magenta toner image is a thin-line image. In the experiment, a re-transfer ratio of the yellow toner image onto the magenta photosensitive drum 1M at the primary transfer position d was adjusted to 1%, 2% and 5%. The re-transfer ratio can be adjusted by changing the primary transfer voltage of the primary transfer voltage source 93. An experiment result is shown together with a comparison example in Table 1. The comparison example is different from this embodiment and is the case where the developing roller 41 is not separated although the blade 70 is separated, i.e., the case where the color mixture of the liquid developers is ventured to be caused to occur.

TABLE 1

| Re-transfer rate | Comparison example | This embodiment |
|---|---|---|
| 1% | 0.150 wt. % | 0.00 wt. % |
| 2% | 0.298 wt. % | 0.00 wt. % |
| 5% | 0.724 wt. % | 0.00 wt. % |

As can be understood from Table 1, in the comparison example, as the re-transfer ratio increases, the amount of the yellow toner included in the magenta liquid developer increases in the order of 0.150, 0.298 and 0.724 wt. %. On the other hand, in this embodiment, irrespective of the re-transfer ratios, the inclusion of the yellow toner in the magenta developer was not able to be ascertained (0.00 wt. %).

As described above, in the case of this embodiment, the developing roller 41 is caused to be separated until before the blade 70 is separated and the drum position h reaches the developing c. Or, the blade 70 is caused to be separated until before the developing roller 41 is separated and the opposing position i reaches the contact position e. According to this, the liquid accumulation formed on the drum surface by the blade 70 is not collected by the developing roller 41. That is, even when the liquid accumulation reaches from the contact position e to the developing position c in response to the separation of the blade 70, the developing roller 41 has already been separated from the photosensitive drum 1 before arrival at the developing position c, so that the liquid accumulation is not collected by the developing roller 41. Then, the toner contained in the liquid accumulation which has not been collected by the developing roller 41 is transferred onto the belt 91 and is removed by the belt cleaning device 11. Thus, by adjusting the separation timings of the blade 70 and the developing roller 41, the liquid accumulation is prevented from being collected by the developing roller 41, so that the color mixture of the liquid developers due to the liquid accumulation does not readily occur.

Second Embodiment

Incidentally, particularly in a case such that images with a high image ratio are continuously formed, the toner of the liquid accumulation transferred on the belt 91 at the image forming portion on the upstream side with respect to the movement direction of the belt 91 is liable to be re-transferred from the belt 91 onto the photosensitive drum 1 at the adjacent image forming portion on the downstream side with respect to the movement direction. In that case, as in the above-described First Embodiment, when the separation timings of the blade 70 and the developing roller 41 are substantially the same at all the image forming portions PY to PBk, there is a liability that another color toner (other color toners) remain(s) on the drum surface(s). That is, the photosensitive drums 1 are contaminated with other color toners. Then, color mixture of the liquid developers occurs during a subsequent image forming job.

Figure 6:
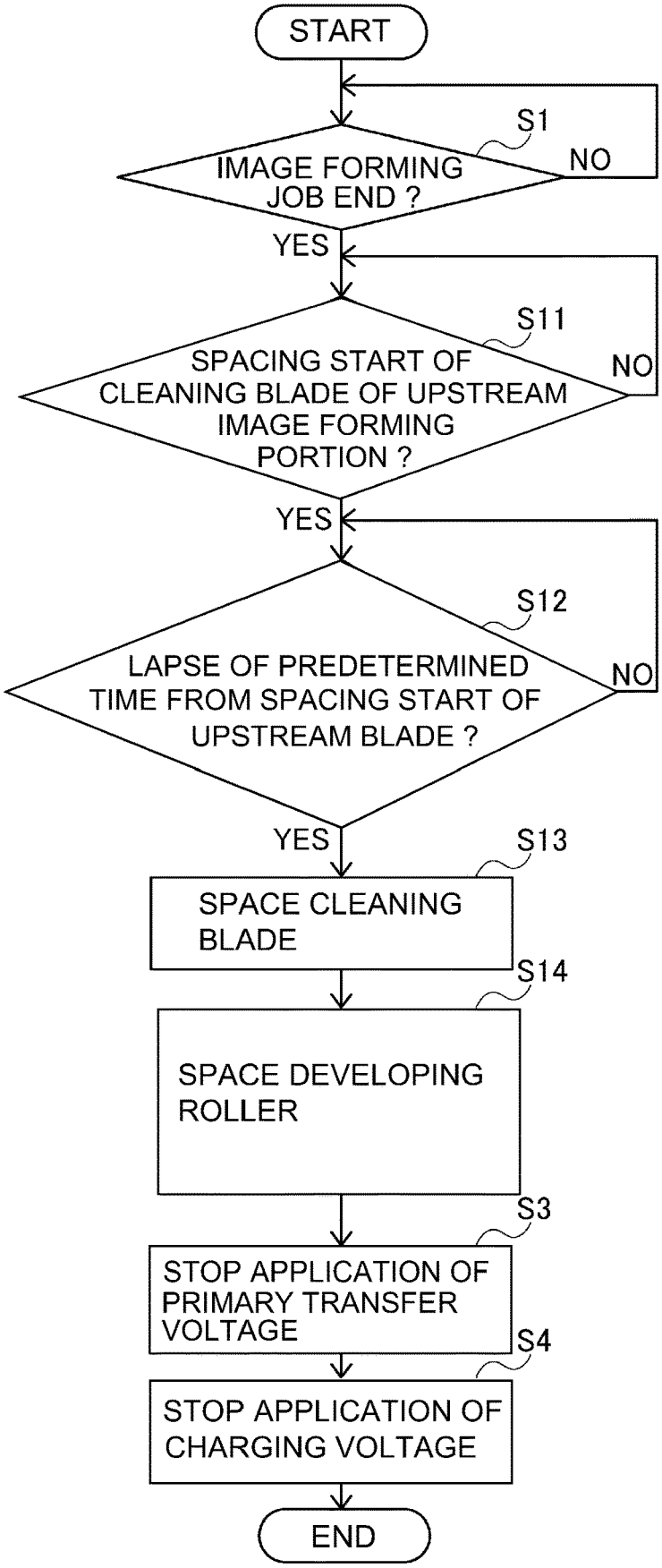
FIG. 6 is a flowchart showing separation control in Second Embodiment.

In view of the above-described points, in Second Embodiment, in an image forming portion on a downstream side with respect to the movement direction, another color toner retransferred on the photosensitive drum 1 via the belt 91 was collected by the blade 70, and thereafter, the blade 70 and the developing roller 41 are caused to be successively separated. This separation control is carried out in the order of the magenta image forming portion PM, the cyan image forming portion PC and the black image forming portion PBk, except for the yellow image forming portion PY. Other constitutions and actions (functions) are similar to those of First Embodiment, and therefore, in the following, a portion different from that of First Embodiment will be principally described. The separation control in Second Embodiment will be described using FIG. 6 and FIG. 7 while making reference to FIG. 1 to FIG. 3. In FIG. 6, the separation control in Second Embodiment is shown. Incidentally, in the following, in order to make description easy to understand, the magenta image forming portion PM will be described as an example.

As shown in FIG. 6, at the time of an end of an image forming job, i.e., during post-rotation (YES of S1), the controller 200 discriminates whether or not separation of the blade 70Y (second blade) is started at the adjacent yellow image forming portion PY on the upstream side with respect to the movement direction (of the belt) (S11). In the case where the separation of the blade 70Y has not yet been started (NO of S11), the controller 200 repetitively carries out a process of S11.

In the case where the separation of the blade 70Y is started (YES of S11), the controller 200 discriminates whether or not a predetermined time has elapsed from the start of the separation of the blade 70Y (S12). The predetermined time in this case is a time required for movement of the toner contained in the liquid accumulation formed by the blade 70 to the contact position e of the blade 70M (first blade) in the magenta image forming portion PM via the belt 91. Specifically, the predetermined time is a cumulative time of a time of movement of the drum position h of the photosensitive drum 1Y to the primary transfer portion T1Y, a time of movement of the belt 91 from the primary transfer portion T1Y to the primary transfer portion T1M, and a time of movement of the photosensitive drum 1M from the primary transfer portion T1M to the contact position e. In the case where the predetermined time does not elapse from the start of the separation of the blade 70Y (NO of S12), the controller 200 repeats a process of S12.

On the other hand, in the case where the above-described predetermined time elapses from the start of the separation of the blade 70Y, i.e., in the case where the cumulative time or more elapses from the start of the separation of the blade 70Y (YES of S12), the controller 200 causes the blade 70M to be separated from the photosensitive drum 1M (S13). After the separation of the blade 70M, the controller 200 causes the developing roller 41M to be separated from the photosensitive drum 1M before the drum position h reaches the developing position c (S14). After the developing roller 41M is separated, the controller 200 causes the primary transfer voltage source 93 to stop application of the primary transfer voltage to the primary transfer roller 92M (S3). After the stop of the application of the primary transfer voltage, the controller 200 causes the charging voltage source 52 to stop application of the charging voltage to the photosensitive drum 1M (S4).

Figure 7:
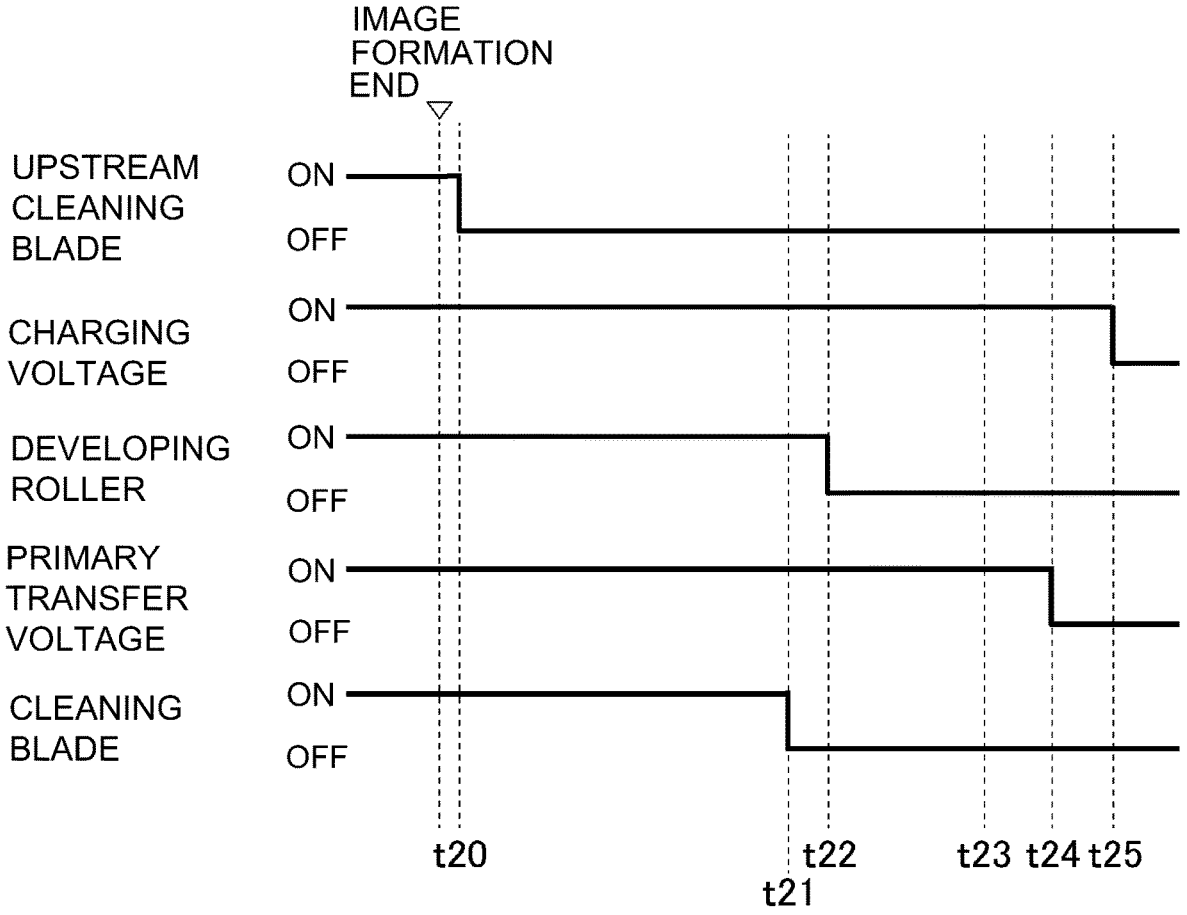
FIG. 7 is a timing chart for illustrating separation control in Second Embodiment.

In FIG. 7, a timing chart of the separation control shown in FIG. 6 in Second Embodiment is shown. As shown in FIG. 7, in the case where the blade 70Y is separated from the photosensitive drum 1Y in the yellow image forming portion PY (t20), after a lapse of a predetermined time or more, the blade 70M is separated from the photosensitive drum 1M in the magenta image forming portion PM. The separation timing of the blade 70M may only be required to be on or after a lapse of 1027 ms, for example, in the case where a time required for one full circumference of each of the photosensitive drums 1Y and 1M is 528 ms and a time required for movement of the belt 91 between the primary transfer positions is 499 ms. By doing so, the blade 70M is not separated until the toner contained in the liquid accumulation formed by the yellow image forming portion PY reaches the contact position e of the magenta image forming portion PM via the belt 91. In other words, the toner contained in the liquid accumulation formed by the yellow image forming portion PY is taken in the liquid accumulation formed by the blade 70M, and then the blade 70M is separated.

Then, after separation of the blade 70M (t21), the developing roller 41M is separated from the photosensitive drum 1M (t22). The separation timing of the developing roller 41M is as has already been described with reference to part (a) of FIG. 5, and may only be required to fall within the time (220 ms) required for rotation of the photosensitive drum 1M from the contact position e to the developing position c. After the separation of the developing roller 41M (t22), application of the primary transfer voltage is stopped (t24). After the stop of the application of the primary transfer voltage (t24), application of the charging voltage is stopped (t25). Respective timings of these stops of the application of the primary transfer voltage and the application of the charging voltage are similar to those in First Embodiment, and therefore, will be omitted here from description.

As described above, also in the case of Second Embodiment, in each of the image forming portions PY to PBk, the blade 70 is separated, and the developing roller 41 is separated until before the drum position h reaches the developing position c. Accordingly, an effect similar to that in the above-described First Embodiment such that the color mixture of the liquid developers due to the liquid accumulation does not readily occur can be obtained. In addition, in Second Embodiment, the toner contained in the liquid accumulation formed in the upstream-side image forming portion with respect to the movement direction (of the belt) is taken in the liquid accumulation formed in the downstream-side image forming portion with respect to the movement direction, and then the blade 70 and the developing roller 41 are separated from the photosensitive drum 1. According to this, another color toner re-transferred from the belt 91 on the photosensitive drum 1 in the downstream-side image forming portion with respect to the movement direction does not remain on the drum surface, so that an effect such that the color mixture is not caused to occur during a subsequent image forming job can be obtained.

Other Embodiments

In the above-described Second Embodiment, the case where the blade 70 is separated earlier than the developing roller 41 was described, but the developing roller 41 may also be separated earlier than the blade 70. In the case of doing so, for example, the separation timing of the developing roller 41 is after a lapse of the above-described predetermined time, and the separation timing of the blade 70 may only be required to fall within a time required for rotation of the photosensitive drum 1 from the developing position c to the contact position e after the separation of the developing roller 41.

Incidentally, in the above-described embodiments, a constitution in which the intermediary transfer belt was used as the intermediary transfer member was described, but the intermediary transfer member may also be, for example, an intermediary transfer drum formed in a drum shape.

Figure 8:
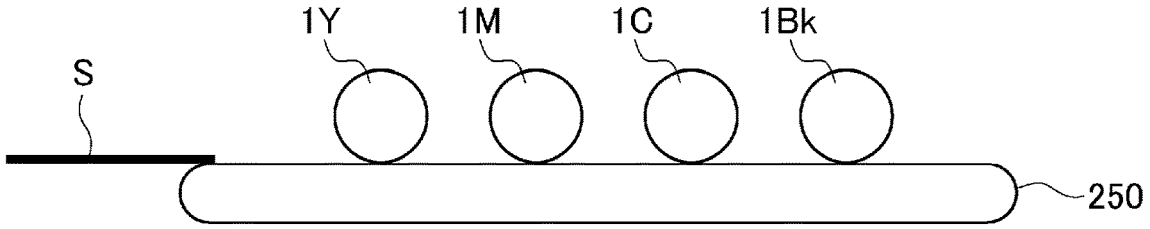
FIG. 8 is a schematic view showing an image forming apparatus of a direct transfer type.

Incidentally, in the above-described embodiments, the image forming apparatus of the tandem type and the intermediary transfer type was described as an example, but the present invention is not limited thereto. The above-described embodiments are, for example, an image forming apparatus of the tandem type and a direct transfer type, as shown in FIG. 8, in which toner images are directly transferred from a plurality of photosensitive drums 1Y to 1Bk onto a recording material S carried out conveyed by a feeding belt 250 as a feeding member.

Further, in the above-described embodiments, a constitution in which the primary transfer voltage is applied when the drum position h passes through the primary transfer position d was described as an example, but the present invention is not limited thereto. For example, when the primary transfer roller 92 contacts the photosensitive drum 1, the color-mixed liquid developer deposited at the drum position h can be transferred on the intermediary transfer belt. In such a case, application of the primary transfer voltage may also be stopped when the drum position h passes through the primary transfer position d. Further, in the case of a constitution in which a separating mechanism for separating the primary transfer roller 92 from the photosensitive drum 1 after an end of the image formation is provided, the primary transfer roller 92 may also be constituted so as to be separated from the photosensitive drum 1 after the drum position h passes through the primary transfer position d.

Further, in this embodiment, a constitution in which the color-mixed liquid developer deposited at the drum position h is transferred on the intermediary transfer belt and is collected by the belt cleaning device 11 provided to the intermediary transfer belt was described as an example, but the present invention is not limited thereto. For example, in the case where a cleaning member is provided to the secondary transfer outer roller 10, the color-mixed liquid developer deposited at the drum position h may also be removed by being transferred onto the secondary transfer outer roller.

Further, in this embodiment, the case where the separation timing of the blade 70 and the separation timing of the developing roller 41 are substantially the same time at all the image forming portions PY to PBk was described, but the present invention is not limited thereto. For example, to the most upstream image forming portion PY, there-transfer toner is not basically carried. Therefore, the most upstream image forming portion PY may also be constituted so that the color-mixed liquid developer deposited at the drum position h is collected by the developing roller 41. That is, a contact and separation operation of the developing roller 41 may also be controlled, so that the developing roller 41 is in a contact position with the photosensitive drum 1 at timing when the drum position h passes through an opposing position to the developing roller 41.

INDUSTRIAL APPLICABILITY

According to the present invention, there is provided an image forming apparatus of an electrophotographic type in which a liquid developer which does not readily cause color mixture due to a liquid accumulation is used.

EXPLANATION OF SYMBOLS

1Y to 1Bk . . . first image bearing member (second image bearing member, photosensitive drum), 4Y to 4Bk . . . first developing means (second developing means, developing device), 11 . . . cleaning means (belt cleaning device), 70Y to 70Bk . . . first blade (second blade, blade), 91 . . . intermediary transfer member (intermediary transfer belt), 92 . . . first transfer means (second transfer means, primary transfer roller), 93 . . . first transfer means (second transfer means, primary transfer voltage source), 100 . . . image forming apparatus, 200 . . . control means (controller), 250 . . . feeding member (feeding belt), PY to PBk . . . image forming portion, S . . . recording material, T1Y to T1Bk . . . first transfer position (second transfer position, primary transfer portion)

The invention claimed is:

1. An image forming apparatus comprising:

an image forming portion for forming an image on a recording material, wherein said image forming portion includes:

a first image forming portion for forming a toner image, a second image forming portion for forming a toner image different in color from the toner image formed by said first image forming portion, and an intermediary transfer member which is provided rotatably and on which the toner images formed by said first image forming portion and said second image forming portion are transferred, wherein said first image forming portion is provided on a side downstream of said second image forming portion with respect to a rotational direction of said intermediary transfer member and is capable of transferring the toner image onto said intermediary transfer member so as to be superposed on the toner image formed by said second image forming portion, wherein said image forming apparatus further includes:

a cleaning member capable of removing the toner images on said intermediary transfer member, and a controller for controlling an operation of said image forming portion, wherein said first image forming portion includes:

a first image bearing member, a first developing device, provided so as to be contactable to and separable from said first image bearing member, for developing an electrostatic latent image formed on said first image bearing member by a liquid developer containing first toner at a first developing position opposing said first image bearing member, a first transfer device, to which a first transfer voltage is to be applied, for transferring the toner image formed on said first image bearing member onto said intermediary transfer member at a first transfer position, and a first blade, provided so as to be contactable to and separable from said first image bearing member, for removing the toner image on said first image bearing member, wherein with an end of image formation, said controller causes said first blade to be separated from said first image bearing member during a rotational operation in which said first image bearing member rotates, wherein during the rotational operation, said controller causes said first developing device to be in a separated position where said first developing device is separated from said first image bearing member when a first opposing position of said first image bearing member to said first blade at a time when said first blade is started to be separated from said first image bearing member reaches the first developing position, and wherein during the rotational operation, said controller causes said first image bearing member to rotate so that the first opposing position passes through the first transfer position after said first blade is separated, and causes the liquid developer remaining on said first image bearing member at the first opposing position to be transferred onto said intermediary transfer member and causes said cleaning device to collect the transferred liquid developer.

2. An image forming apparatus according to claim 1, wherein at a time of an end of an image forming job, said controller causes said first developing device to be separated from said first image bearing member after said first blade is started to be separated from said first image bearing member and before the first opposing position reaches the first developing position.

3. An image forming apparatus according to claim 1, wherein at a time of an end of an image forming job, said controller causes said first blade to be in a separated position where said first blade is separated from said first bearing member before a position of said first image bearing member being in the first developing position at a time of the start of separation of said first developing device from said first image bearing member reaches a contacted position where said first blade is contacted to said first image bearing member.

4. An image forming apparatus according to claim 1, wherein at a time of an end of an image forming job, said controller stops application of the first transfer voltage to said first transfer device after said first blade is separated from said first image bearing member and after the first opposing position passes through the first transfer position.

5. An image forming apparatus according to claim 1, wherein said second image forming portion includes:

a second image bearing member, a second developing device, provided so as to be contactable to and separable from said second image bearing member, for developing an electrostatic latent image formed on said second image bearing member by a liquid developer containing second toner different in color from the first toner at a second developing position opposing said second image bearing member, a second transfer device for transferring the toner image formed on said second image bearing member onto said intermediary transfer member at a second transfer position, and a second blade, provided so as to be contactable to and separable from said second image bearing member, for removing the toner image on said second image bearing member.

6. An image forming apparatus according to claim 1, wherein with an end of image formation, said controller causes said second blade to be separated from said second image bearing member during a rotational operation in which said second image bearing member rotates, wherein during the rotational operation, said controller causes said second developing device to be in a separated position where said second developing device is separated from said second image bearing member when a second opposing position of said second image bearing member to said second blade at a time when said second blade is started to be separated from said second image bearing member reaches the second developing position, wherein during the rotational operation, said controller causes said second image bearing member to rotate so that the second opposing position passes through the second transfer position after said second blade is separated, and causes the liquid developer remaining on said second image bearing member at the second opposing position to be transferred onto said intermediary transfer member and causes said cleaning device to collect the transferred liquid developer, and wherein during the rotational operation, said controller carries out contact so that said first blade is separated from said first image bearing member after a lapse of a predetermined time or more from a start of separation of said second blade from said second image bearing member, said predetermined time is not less than a cumulative time of a time of movement of the second cleaning position, of said second image bearing member to said second blade, to the second transfer position, a time of movement of said intermediary transfer member from the second transfer position to the first transfer position, and a time of movement of said first image bearing member from the first transfer position to the first cleaning position.

7. An image forming apparatus according to claim 5, wherein with an end of image formation, said controller causes said second blade to be separated from said second image bearing member during a rotational operation in which said second image bearing member rotates, and wherein during the rotational operation, said controller causes said second developing device to be in a contact position to said second image bearing member when a second opposing position wherein said second image bearing member opposes said second blade at a time of a start of separation of said second blade from said second image bearing member reaches the second developing position.

8. An image forming apparatus according to claim 1, wherein said controller stops rotations of said first image bearing member and said intermediary transfer member after said first blade is separated from said first image bearing member during the rotational operation and after a position of said intermediary transfer member opposing the transfer position when the first opposing position reaches the first transfer position reaches said cleaning member.

* * * * *